US006754452B2

(12) United States Patent
Kurtz

(10) Patent No.: US 6,754,452 B2
(45) Date of Patent: Jun. 22, 2004

(54) PROGRAMMABLE AUDIBLE SIGNAL FOR ENUNCIATING IMAGING MACHINE ANOMALY CONDITIONS

(75) Inventor: Barry D. Kurtz, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/047,099

(22) Filed: Jan. 14, 2002

(65) Prior Publication Data

US 2003/0133718 A1 Jul. 17, 2003

(51) Int. Cl.[7] ..... G03G 15/00
(52) U.S. Cl. ..... 399/9; 399/18; 399/21
(58) Field of Search ..... 399/8, 9, 13, 18, 399/21, 24, 42, 81; 371/21.6; 714/2, 25, 26, 30, 31, 42, 46, 48

(56) References Cited

U.S. PATENT DOCUMENTS 4,572,652 A * 2/1986 Tada et al. ..... 399/81
4,617,661 A * 10/1986 Futaki et al. ..... 399/9
5,414,494 A * 5/1995 Aikens et al. ..... 399/1

OTHER PUBLICATIONS

Dewitt, Robert, "Printer Survey", Digital Antic, Antic vol. 2, No. 10, Jan., 1984, p. 53.

* cited by examiner

*Primary Examiner*—Hoan Tran

(57) ABSTRACT

A system for enunciating imaging machine anomaly conditions is provided. The system has a control unit, memory, a logic interface unit, and an audible signal generator. Audible signals are custom mapped to individual imaging machine anomaly or exception conditions by a user. The customized mapping of audibly signals is provided by a user mapping interface and alerts nearby personnel to both the specific anomaly condition and to the specific office machine in need of attention. The selection of audible signals may range from tones, chimes, music, and verbal communications to user customized sound bytes.

24 Claims, 5 Drawing Sheets

PROGRAMMABLE AUDIBLE SIGNAL FOR ENUNCIATING IMAGING MACHINE ANOMALY CONDITIONS

FIELD OF THE INVENTION

This invention relates generally to imaging machines, and more particularly, to an imaging machine system for mapping audible signals to corresponding imaging machine anomaly conditions. The invention further relates to a system for audibly identifying individual imaging machines and further identifying its particular anomaly condition without the need for visual examination.

BACKGROUND OF THE INVENTION

Office machines that display anomaly or exception conditions, such as "paper jam," "paper out," "toner low," and "service machine" are well known in the art. Most imaging machines, such as, printers, facsimile machines, copiers, and all in one combination machines, today have visual displays to inform the user of an anomaly or exception conditions. Some of these machines have preprogrammed non-selectable audible tones to alert a user of an anomaly or exception condition. The occurrence of some anomalies, for example "paper out," may be displayed on the user's computer screen. Other anomalies, such as "toner low" and "paper jam" may not be displayed on the user's computer screen. Thus, the person who initiated the imaging request may or may not know of the imaging machine anomaly. The occurrence of critical anomalies, such as "paper out" and "paper jam" prevent the normal usage and expected workflow of the machine. Other anomalies, such as "toner low" require attention in the near future, but may not prevent the completion of the job at hand.

Many imaging machines, such as printers, are accessed through a network connection and are often located remotely from the user. In many instances, groups of imaging machines are located in one central area. The current art does not sufficiently alert the person in charge of tending to the machines that an anomaly has occurred. The attending person must continually check each machine to determine whether an anomaly has occurred. Furthermore, anomalies that occur in machines that are located in a common area, which are attended to only by persons passing by, may go unnoticed for a considerable length of time. One attempt at curing these deficiencies is to provide a simple audible tone such as a "beep" when an anomaly occurs. However, in the event that more then one machine is located in a common area, a simple audible tone indicating that an anomaly has occurred does not inform the attendant of the type of anomaly, and does not identify which machine has been affected. Furthermore, the single audible tone does not inform the attending person whether the anomaly is one that requires immediate attention or one that can be addressed in the near future.

Hence, there is a need for an imaging machine system that notifies the user of anomaly conditions and does not suffer from the aforementioned deficiencies.

SUMMARY OF THE INVENTION

The present invention solves the aforementioned problems and allows a user to custom map or assign audible signals to correspond to different anomaly conditions and different machines. In one embodiment, an imaging machine system having a control unit, a memory for storing audible signals, an audible signal generator for outputting the audible signal, a logic interface for assigning audible signals to the image machine anomalies is provided.

The audible signals can be, but are not limited to, tones, beeps, chimes, jingles, music, and verbal commands. The user may choose audible signals that are meaningful to him or her so that an anomaly may be recognized without approaching the machine. Critical anomalies, such as "paper out" and "paper jam" can easily be distinguished from non-critical anomalies, such as "toner low" and "service machine" by mapping different audible signals to these conditions. The logic interface of the present invention also provides for the volume and frequency control of the enunciated anomaly to be set such that critical anomalies are louder and repeated more often then those of less importance. Similarly, each imaging machine may be programmed to enunciate an anomaly with an audible signal that is unique and distinguishable from the other imaging machines in the area, thus, permitting the attendant to immediately know that an anomaly condition has occurred and which machine is in need of attention.

In one preferred embodiment, the imaging machine is preprogrammed with a plurality of audible signals. In addition, the imaging machine is programmed to recognize various anomaly conditions through conventional diagnostics. These conditions may include, but are not limited to, "toner low", "paper out", "paper jam", "tray open", "network disconnected", and "service machine." In this regard, the user can select any one of a plurality of anomaly conditions and select any one of a plurality of audible signals that enunciate the anomaly condition. The user may decide that some anomaly conditions warrant an audible signal, while others do not. For example, one of the selectable audible signals may be Beethoven's Fifth Overture and the user may select such an audible signal to correspond to the "paper out" anomaly, while two beeps may be selected to correspond to the "toner low" anomaly, and the "tray open" anomaly may not be assigned any audible signal. Thus, when the machine is out of paper the system will play Beethoven's Fifth Overture. When the toner is low, the system will output two beeps, and when the paper tray is open the system will not provide any audible signal.

The volume of each anomaly condition can be individually controlled. This is particularly useful because critical anomalies should be handled promptly while non-critical anomalies may be ignored for a brief time. Thus, Beethoven's Fifth Overture indicating the "paper out" anomaly may be louder then the volume of the two beeps indicating the "toner low" anomaly. In addition, the repetition frequency for the enunciation of different machine anomalies may be controlled. Critical anomalies may be set to enunciate more frequently than non-critical anomalies. For example, Beethoven's Fifth Overture, indicating paper out, may be played every few minutes, while the two beeps, indicating toner low may be set for every few hours.

The preferred embodiment has a system volume control to adjust the overall volume of the machine making it suitable to a variety of office environments. Machines in loud environments may be set at higher volume levels then machines in quiet environments. Machines with attendants close by may be set at lower volume levels then machines that are in a remote location. The audible signals may be mapped to the machine anomalies by a control panel located on the machine, through a network connection, or via a direct connection to a computer.

In yet another embodiment, the user can create personalized audible signals to correspond to machine anomaly conditions. The user can download sound samples from compact discs or a personal computer. The sound samples can be stored in the imaging machine system memory allowing the user to create audible signals that have special meaning. These personalized audible signals can be mapped to one or more of the printer anomalies enabling quick and easy recognition of the anomalies and their corresponding machine. These sound samples may be loaded into the memory through a network connection to the imaging machine, or loaded directly into the imaging machine through a connection port to a personal computer, a laptop computer, a hand held computer, or other medium for transmitting digital signals.

In yet another embodiment, an imaging machine is equipped with a microphone and a digital sampler. This configuration makes it possible for the user to directly input sound samples and personal messages into the imaging machine's system memory which can then be mapped to one or more of the anomaly conditions, as stated earlier.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION OF ILLUSTRATED EMBODIMENT

The present invention provides a programmable audible signal for enunciating image machine anomaly conditions. The audible signals alert the user to an anomaly that has occurred and which imaging machine the anomaly has occurred on. The present invention facilitates alerting the user to the various anomalies by allowing the user to assign at least one of a plurality of audible signals to at least one of a plurality of imaging machine anomaly conditions.

Figure 1:
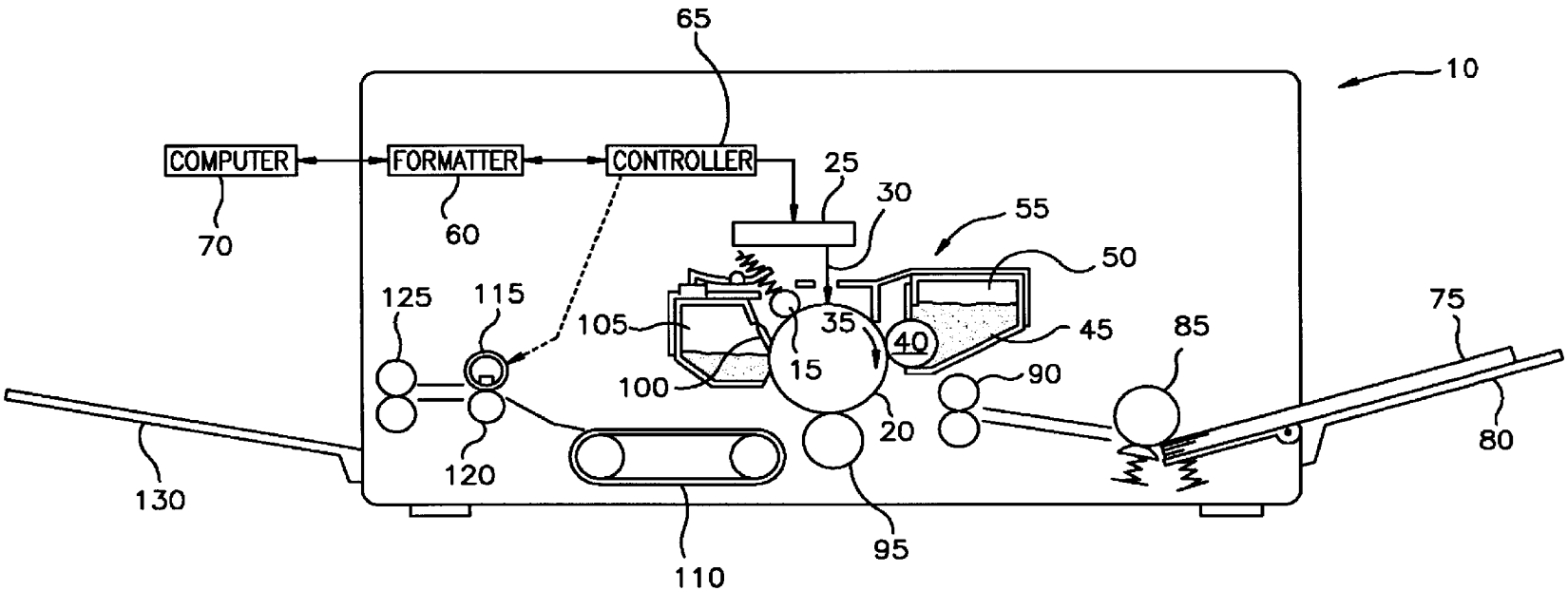
FIG. 1 is a simplified diagram of an imaging machine.

Illustrated in FIG. 1 is a simplified cross sectional view of an embodiment of an exemplary electrophotographic imaging machine such as an electrophotographic printer 10. The printer includes, for example, a charge roller 15 that charges the surface of a photoconductor, such as photoconductor drum 20, to a predetermined voltage. A laser scanner 25 includes a laser diode (not shown) that emits a laser beam 30 onto the photoconductor drum 20 to selectively discharge its surface. The laser beam is reflected off a multifaceted spinning mirror (not shown) that reflects or "scans" the beam across the surface of the photoconductor drum 20 forming a latent electrostatic image corresponding to the data being printed. The photoconductor drum 20 rotates in a clockwise direction as shown by the arrow 35 such that each successive scan of the laser beam is recorded on the drum 20 after the previous scan.

To this end, the embodiment of the electrophotographic imaging device shown in FIG. 1 includes a software configured processing device, such as formatter 60 and controller 65. Alternatively, the electrophotographic printer 10 could use other processing devices such as a microprocessor, or other digital state machines. To form the latent electrostatic image, the formatter 60 receives data, including print data (such as, a display list, vector graphics, or raster print data) from a software program running on a computer 70. The formatter 60 converts the print data into a stream of binary print data that is an electronic representation of each page to be printed, and sends it to the controller 65. The controller 65 supplies the stream of binary print data to the laser scanner 25 causing the laser diode to pulse in accordance with the data, thus creating the latent electrostatic image on photoconductor drum 20. In addition, the formatter 60 and controller 65 exchange data necessary for controlling the electrophotographic printing process as known in the art for a particular imaging device.

With further reference to FIG. 1, after the surface voltage of the drum 20 has been selectively discharged, a developing device, such as a developing roller 40, transfers toner to the surface of the drum 20. Toner 45, for example, is stored in a toner reservoir 50 of a toner print cartridge 55. A magnet (not shown) located within the developing roller 40 magnetically attracts the toner 45 to the surface of the developing roller. As the developing roller 40 rotates, the toner is electrostatically transferred from the developing roller to the discharged surface areas on the photoconductor drum 20 thus covering the latent electrostatic image with toner particles.

A print media 75, such as paper, envelops, transparencies, etc., is loaded from a media tray 80 by a pickup roller 85 and travels in a printing path in the electrophotographic printer 10. The print media 75 moves through drive rollers 90 so that the arrival of the leading edge of the print media 75 at a transfer point below the photoconductor drum 20 is synchronized with the rotation of the latent electrostatic image on the drum 20. There, a transfer device, such as a transfer roller 95, charges the print media so that it attracts the toner particles away from the surface of the photoconductor drum 20. As the drum 20 rotates, the toner adhered to the discharged areas contacts the charged print media 75 and is transferred thereto. The transfer of toner particles from the drum 20 to the surface of the print media 75 is not always complete and some toner particles may remain on the drum 20. To clean the drum 20, a cleaning blade 100 may be included to remove non-transferred toner particles as the drum continues to rotate and the toner particles are deposited in a toner waste hopper 105. The drum may then be completely discharged by discharge lamps (not shown) before a uniform charge is restored to the drum 20 by the charging roller 15 in preparation for the next toner transfer.

As the print media 75 moves in the printing path past the photoconductor drum 20, it enters a post transfer area. There, a conveyer 110 delivers the print media 75 to a fixing device, such as a heated fuser roller 115 and a heated pressure roller 120. As the media passes between the rollers, the toner is fused to the media through a process of heat and pressure. One or both rollers are motor driven to advance the media 75 between them. The fuser roller 115 is, for example, constructed with a hollow metal core and an outer layer often made of a hard "release" material such as Teflon®. A heating device, such as a ceramic heating strip 117 is positioned inside the core along the length of the fuser roller 115. Other heating devices may include a quartz lamp, heating wires or other suitable heating element as known in the art. The pressure roller 120 is, for example, constructed with a metal core and a pliable outer layer. The pressure roller may also include a thin Teflon® release layer (not shown). After fusing the toner to the print media, output rollers 125 push the print media into an output tray 130 and printing is complete.

With continued reference to FIG. 1, the controller 65 also controls a high voltage power supply (not shown) to supply voltages and currents to components used in the electrophotographic processes, such as to the charge roller 15, the developing roller 40, and the transfer roller 95. Furthermore, controller 65 controls a drive motor (not shown) that provides power to a gear train (not shown) and controls various clutches and paper feed rollers necessary to move the print media through the printing path within the electrophotographic printer 10. It will be appreciated that different imaging devices may have components and control mechanisms different than those shown in the exemplary system of FIG. 1. One of ordinary skill will appreciate that the present invention will apply to other devices in accordance to their particular configuration and obvious modifications.

Figure 2:
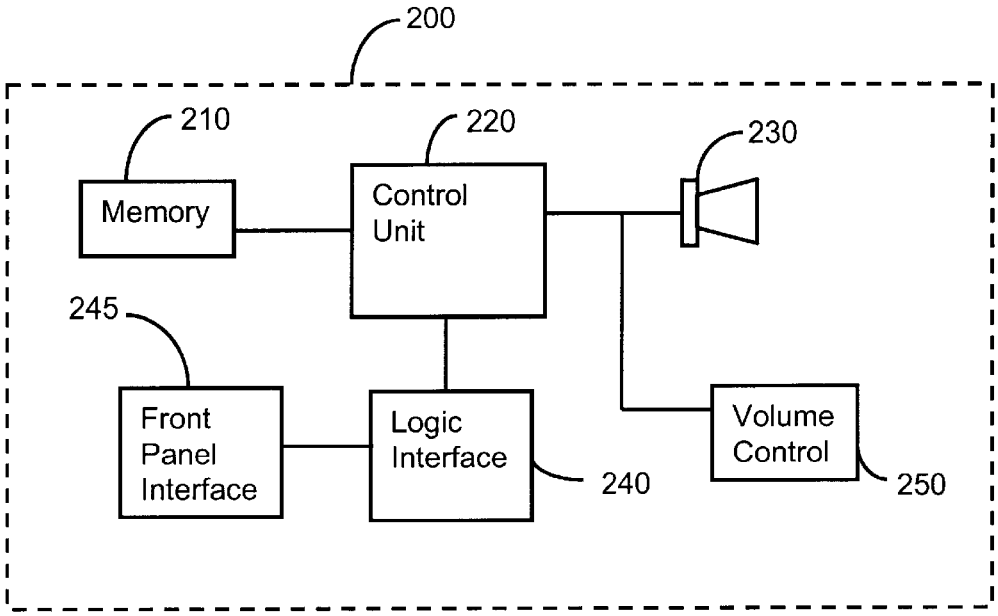
FIG. 2 is a simplified diagram of an imaging machine with an anomaly mapping system and a local mapping interface.

Referring now to FIG. 2, a first embodiment of an imaging machine 200 with an anomaly mapping system is shown. The imaging machine includes, for example, memory 210, control unit 220, an audible signal generator 230, a volume control 250, and a logic interface 240. The memory 210 is for storing at least one of a plurality of audible signals and their enunciation parameters which are mapped to at least one of a plurality of anomaly conditions. The control unit 220 is preferably a microprocessor-based unit capable of executing instructions for recognizing anomaly conditions, receiving the mapped audible signals, and outputting the mapped audible signal at the occurrence of an anomaly condition. The audible signal generator 230 is preferably an acoustic speaker for receiving and enunciating the audible signal. The volume control 250 is of conventional design and is used for adjusting the overall machine volume. This allows the user to adjust the machine volume to fit the particular office environment. As will be described in more detail, the logic interface 240 allows the user to assign the audible signals to the imaging machine anomalies. A front panel interface 245 is also provided for allowing the user to directly access logic interface 240 from the front control panel of the imaging machine 200.

In this embodiment, the audible signals are pre-stored in the memory 210. The audible signals may be any one of a combination of chimes, music, tones, verbal commands, jingles, beeps, or other sounds. For example, the pre-stored list might include two chimes, two beeps, Beethoven's Fifth Overture, a company jingle, and a "check toner" verbal command. In addition, memory 210 contains a list of imaging machine anomalies. These anomalies may be any condition that occurs in imaging machines and requires attention from the user. The anomalies may be critical conditions, such as "paper out" or "paper jam" or non-critical conditions, such as "toner low" or "service machine." The user has the ability to select audible signals from the pre-stored list and assign the selected audible signal to an anomaly condition via the logic interface 240. Thus, the user may select Beethoven's Fifth Overture and map it to the "paper out" anomaly. The audible signal that has been mapped to the anomaly condition is stored in the memory 210. The user can set the enunciation parameters, such as volume and frequency, for the mapped audible signals. In operation, upon the occurrence of an anomaly condition, the control unit 220 retrieves the mapped audible signal and enunciation parameters and outputs the signal to the audible signal generator 230. Thus, in the present example, when the imaging machine runs out of paper, the user will hear Beethoven's Fifth Overture. The Fifth Overture will be played at the set volume and repeated at the set frequency.

Figure 3:
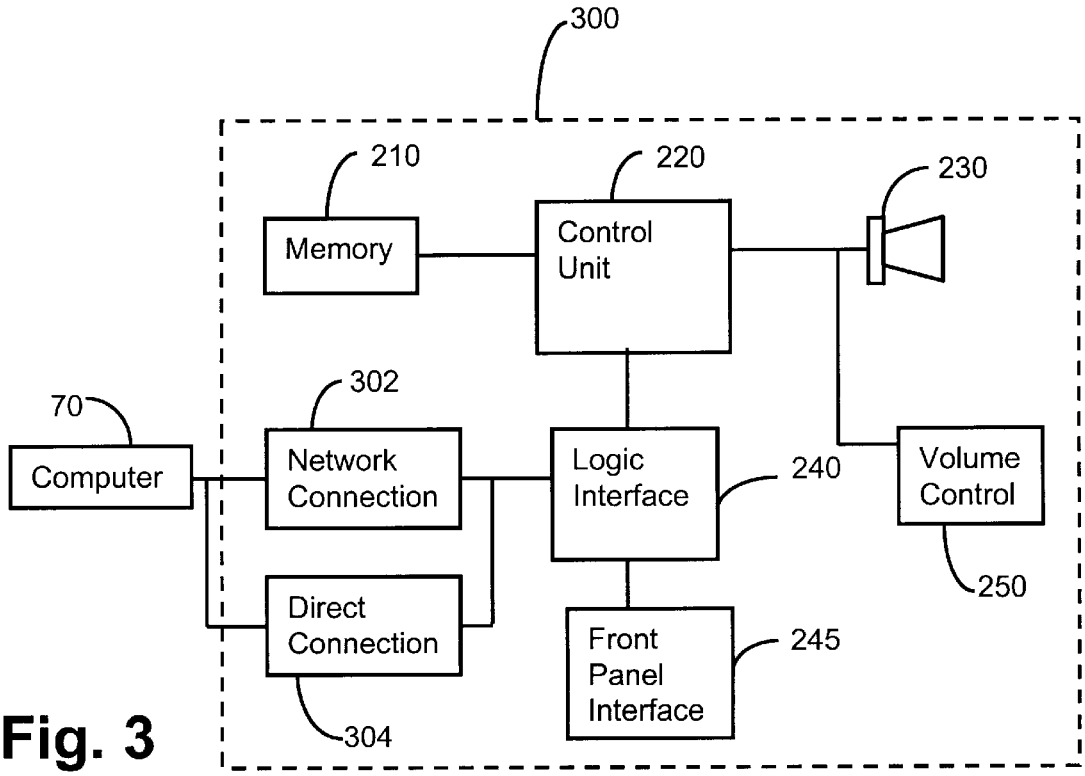
FIG. 3 is a simplified diagram of an imaging machine with an anomaly mapping system and remote mapping interface.

Referring now to FIG. 3, a second embodiment of an imaging machine 300 is shown. The imaging machine 300 is substantially similar to the second embodiment 200, except a computer 70 is linked to the imaging machine 300 through a network connection 302 or, alternately, a direct connection 304 port. The network connection 302 and direct connection 304 permit the user to download customized "sound samples" from the computer 70 to the imaging machine memory 210. "Sound samples" include, but are not limited to music, tones, verbal prompts, etc. Sound samples can be obtained by a variety of methods such as, for example, sampling from a compact disc, downloading from the Internet, or recording directly to computer 70.

To this end, the embodiment of FIG. 3 provides for the audible signals to be selected and stored at the time of manufacture or to be selected and stored in the memory 210 by the user. Thus, the user has the ability to create custom sound samples that have special meaning. The sound samples may be updated and changed to meet the preference of new users or changed at different times of the year, such as assigning holiday songs to the anomalies during the holiday.

Figure 4:
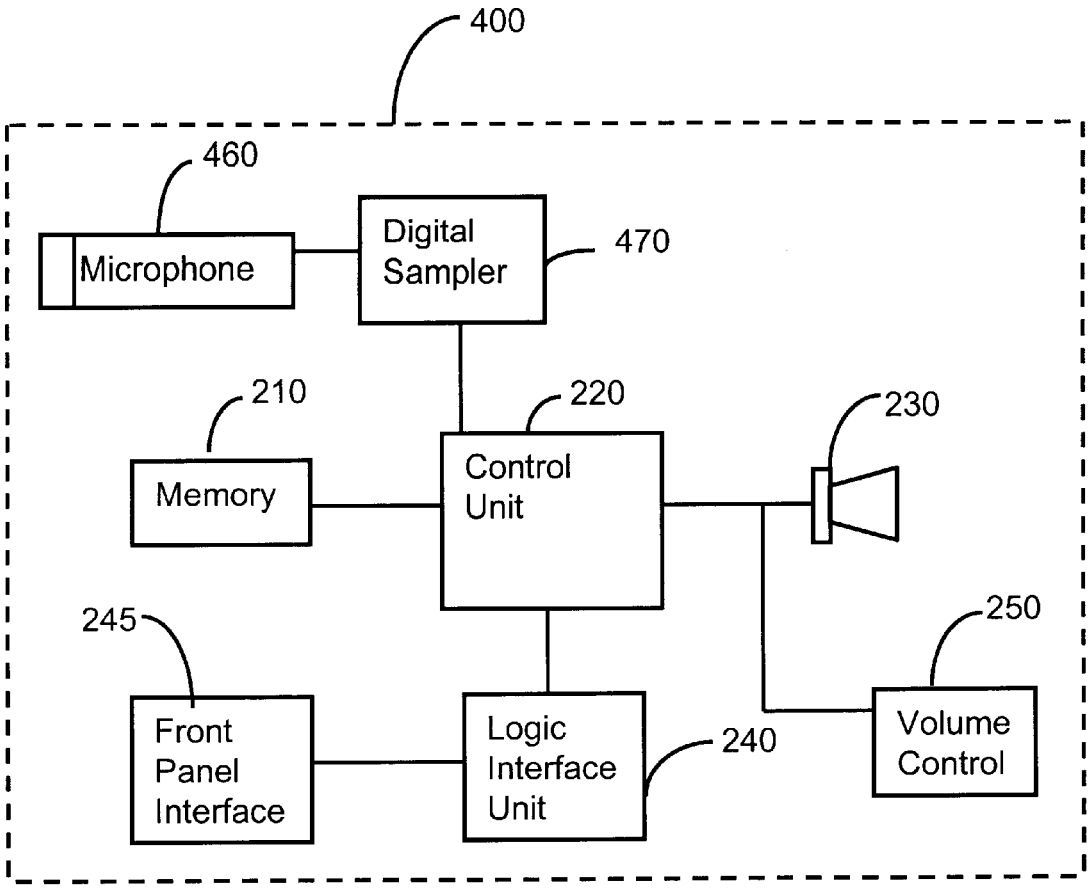
FIG. 4 is a simplified diagram of an imaging machine with an anomaly mapping system for directly inputting audible signals.

Referring now to FIG. 4, a third embodiment of an imaging machine 400 is shown. The imaging machine 400 is substantially similar to the second embodiment 200, except that it has a microphone 460 and a digital sampler 470. The microphone 460 is for directly inputting sound samples into imaging machine 400. The digital sampler 470 preferably a digital signal processing system for receiving sound samples from the microphone 460 and for converting the sound sample into a digital signal. The digital sampler 470 can also work with control unit 220 to properly generate and enunciate an audible signal.

To this end, the embodiment of FIG. 4 provides for the audible signals to be selected and stored at the time of manufacture or to be directly input into the imaging machine and stored in the memory 210 by the user. The direct input may consist of verbal commands, such as "Tom, please add paper" or other sound sample that are played into the microphone. Thus, the user can custom program sound samples without the use of an external device, such as a computer.

Figure 5:
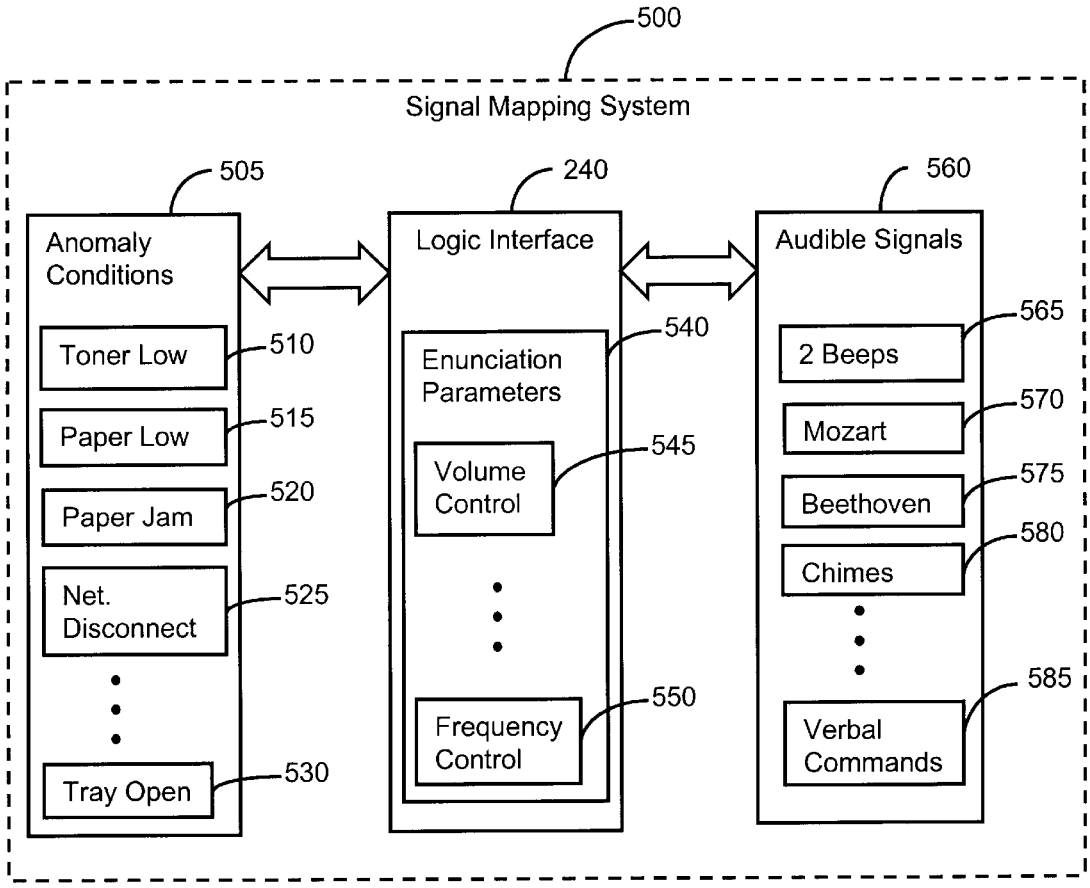
FIG. 5 is a diagram of a logic interface for mapping audible signals to anomaly conditions.

FIG. 5 illustrates a signal mapping system 500 of the present invention. The signal mapping system 500 includes, for example, a plurality of anomaly conditions 505. The plurality of anomaly conditions 505 include at least the following anomalies: toner low 510, paper out 515, paper jam 520, network disconnected 525, and tray open 530. The signal mapping system 500 further includes at least one of a plurality of audible signals 560. The audible signals 560 can include, for example, 2 beeps 565, Mozart 570, Beethoven 575, chimes 580, or verbal commands 585. The signal mapping system 500 also includes logic interface 240 that permits a user to assign any of the audible signals 560 to any of the anomaly conditions 505. In this regard, the logic interface 240 includes a set of enunciation parameters 540 that may be assigned to the mapped audible signals 560 and anomaly conditions 505. The enunciation parameters 540 include, for example, volume control 545 and frequency control 550. The volume control 545 permits the user to set the individual volume of each enunciated signal. Thus, the user may set critical anomalies, such as paper out 515 to enunciate louder than non-critical anomalies, such as toner low 510. Similarly, the frequency control 550 permits the user to set the repetition frequency of each anomaly condition individually. Thus, the user may set critical anomalies, such as paper out 515 to enunciate every few minutes, while non-critical anomalies, such as toner low 510 to enunciate every few hours.

Figure 6:
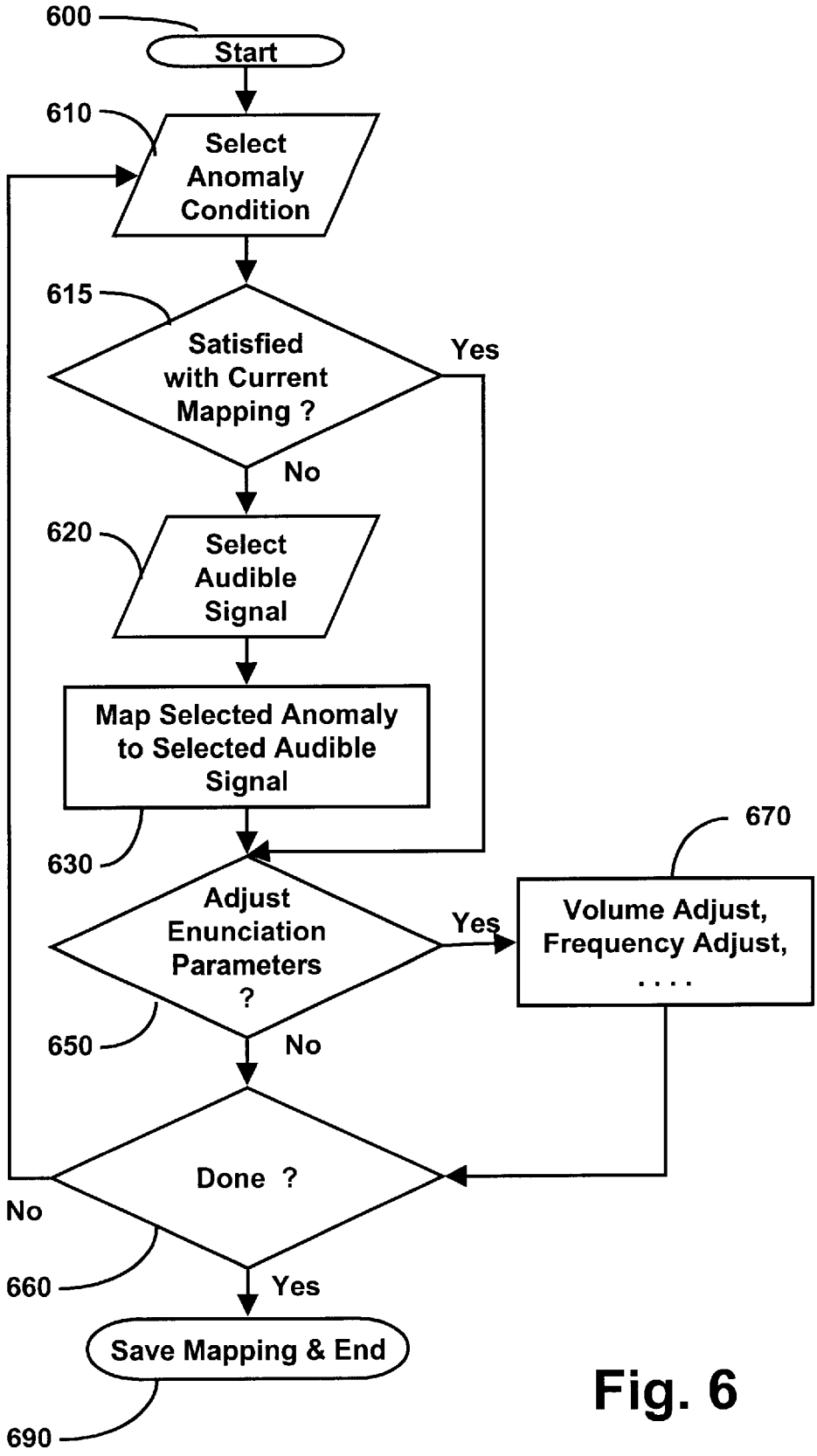
FIG. 6 is a flow diagram for mapping audible signals to anomaly conditions.

Referring now to FIG. 6, a flow chart illustrating the logic executed by logic interface 240 is shown. The user enters the programming mode by selecting the start input 600. In step 610, the user selects an anomaly condition such as, for example, paper out. In step 615, the user is queried whether the presently assigned audible signal (if any) with respect to the selected anomaly condition is acceptable. If yes, the logic branches down to step 650. If no, the logic proceeds to step 620. In step 620, the user is prompted to select an audible signal to correspond to the selected anomaly condition. The audible signal may be one that is programmed at the time of manufacture, a sound sample programmed by the user, or a verbal command directly input by the user through a microphone on the imaging machine. In step 630, the mapped signal is stored in memory. The logic then proceeds to step 650. In step 650, the user is queried on whether to adjust the enunciation parameters of the mapped audible signal. If the user selects "yes," the enunciation parameters are displayed in step 670 and the user may adjust the parameters. In step 660, the user is queried whether the changes are completed. If the user selects "yes," the audible signal and its enunciation parameters are mapped to the anomaly condition and then stored in memory in step 690. If the user selects "no," the logic loops back to step 610 and the process is repeated. The process is repeated until the mapping is complete and the user selects "yes" in step 660.

Hence, the present invention facilitates the audible identification of individual imaging machines and the further identification of the particular anomaly condition that has occurred without the need for visual examination.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the types of audible tones can be expanded beyond chimes, music, tones, and voices to include any type of sound such as, for example, animal or nature sounds. Therefore, the invention, in its broader aspects, is not limited to the specific details, the representative apparatus, and illustrative examples shown and described. Accordingly, departures can be made from such details without departing from the spirit or scope of the applicant's general inventive concept.

I claim:

1. A system for enunciating imaging machine anomaly conditions wherein the system comprises:

a control unit;

a memory in circuit communication with said control unit;

audible signal generator in circuit communication with said control unit; and a user logic interface configured to allow a user to assign and map a selected audible signal from at least one of a plurality of audible signals to a selected machine anomaly condition from at least one of a plurality of machine anomaly conditions.

2. The system of claim 1 wherein said user logic interface further comprises a volume control configured to allow the user to individually set different signal volume amplitudes for different selected audible signals from the at least one of said plurality of audible signals that correspond to at least one of said plurality of machine anomaly conditions.

3. The system of claim 1 wherein said system further comprises of a system volume control in circuit communication with said audible signal generator for adjusting the image machine volume.

4. The system of claim 1 wherein said user logic interface further comprises a frequency control configured to allow the user to adjust a repetition frequency for a selected audible signal from the at least one of said plurality of audible signals that correspond to at least one of said plurality of machine anomaly conditions.

5. The system of claim 1 wherein said user logic interface is configured to re-assign a selected audible signal corresponding to a machine anomaly condition based on a user selection.

6. The system of claim 1 wherein the plurality of audible signals are pre-stored in the memory for the user to select at least one audible signal to correspond to at least one of said plurality of machine anomaly conditions.

7. The system of claim 1 wherein said memory is programmable for storing user downloaded audible signals.

8. The system of claim 1 wherein the at least one of a plurality of the machine anomaly conditions is selected from the group consisting of: paper out, toner low, and paper jam.

9. The system of claim 1 wherein the at least one of a plurality of audible signals is selected from the group consisting of: music, voices, chimes and combinations of the foregoing.

10. The system of claim 1 wherein said user logic interface is configured to re-assign a selected audible signal corresponding to a machine anomaly condition based on a user selection.

11. A system for mapping imaging machine anomaly status conditions wherein the system comprises a memory, a control unit, an audible signal generator, and a mapping interface configured to allow a user to selectively map at least one of a plurality of audible signals to at least one of a plurality of machine anomalies, the mapping interface comprising:

a volume control configured to allow the user to individually set a signal volume amplitude of a selected audible signal from the at least one of said plurality of audible signals that correspond to at least one of said plurality of system anomaly conditions, and a frequency control configured to allow the user to individually adjust a repetition frequency of a selected audible signal from the at least one of said plurality of audible signals that correspond to at least one of said plurality of system anomaly conditions.

12. The system of claim 11 wherein the frequency comprises at least one minute.

13. The system of claim 11 wherein the frequency comprises at least one-half hour.

14. The system of claim 11 wherein the at least one of a plurality of the system anomaly conditions includes at least one of paper out, toner low, and paper jam.

15. The system of claim 11 wherein the at least one of a plurality of audible signals includes at least one of music, voices, and chimes.

16. The system of claim 11 wherein said memory comprises said at least one of a plurality of audible signals.

17. The system of claim 11 wherein said memory comprises at least one of a plurality of audible signals mapped to at least one of a plurality of system anomaly conditions.

18. A system for mapping imaging device anomaly conditions comprising:

a plurality of audible signals;

a plurality of anomaly conditions;

a signal mapping system configured to assign a selected audible signal from the plurality of audible signals to one or more selected anomaly conditions from the plurality of anomaly conditions in accordance with assignment instructions received from a user; and the signal mapping system being configured to cause an imaging device to generate an audible signal assigned to an anomaly condition in response to the anomaly condition occurring.

19. The system of claim 18 wherein the signal mapping system comprises a volume control configured to assign different signal volume amplitudes to selected audible signals that corresponds to at least one of said plurality of machine anomaly conditions in accordance with instructions from a user.

20. The system of claim 18 wherein the signal mapping system comprises a frequency control for adjusting a repetition frequency of at least one of said audible signals that correspond to at least one of said plurality of anomaly conditions based on instructions from a user.

21. The system of claim 18 wherein the plurality of anomaly conditions includes at least one of paper out, toner low, and paper jam.

22. The system as set forth in claim 18 wherein the signal mapping system is configured to allow the user to customize audible signals associated with an anomaly condition.

23. The system as set forth in claim 18 further including means for inputting a user generated audible signal and including the user generated audible signals with the plurality of audible signals.

24. A method of configuring an imaging device comprising:

providing a one or more audible signals associated with one or more imaging device conditions; and configuring the imaging device by selectively changing associations between the one or more audible signals and the one or more imaging device conditions in accordance with user instructions.

* * * * *